US005373592A

United States Patent [19]

Stoltenberg et al.

[11] Patent Number: 5,373,592

[45] Date of Patent: Dec. 20, 1994

[54] PLUMBING TRAP WATER COLLECTION DEVICE

[75] Inventors: Michael R. Stoltenberg, Des Plaines; Brian Neuhaus, Antioch, both of Ill.

[73] Assignee: Sloan Valve Company, Franklin Park, Ill.

[21] Appl. No.: 164,708

[22] Filed: Dec. 10, 1993

[51] Int. Cl.[5] ..... E03C 1/28

[52] U.S. Cl. ..... 4/661

[58] Field of Search ..... 4/226.1, 661; 137/247.25, 561 A

[56] References Cited

U.S. PATENT DOCUMENTS

| | | | |
|---|---|---|---|
| 3,591,873 | 7/1971 | Cheng | 4/226.1 |
| 4,218,786 | 8/1980 | Taglarino | 4/661 X |
| 4,882,789 | 11/1989 | Kraverath | 4/661 X |

*Primary Examiner*—Robert M. Fetsuga

*Attorney, Agent, or Firm*—Dorn, McEachran, Jambor & Keating

[57] ABSTRACT

This is a device for collecting water from a vacuum breaker tube that connects a toilet flush valve to a toilet bowl and conveys the collected water to a trap located beneath the toilet bowl. There is a conduit, one end of which is in communication with the vacuum breaker tube and the other end of which is in communication with the trap. There is a water scoop positioned within the vacuum breaker tube and in fluid connection with the conduit. The scoop is formed and adapted, regardless of its orientation within the vacuum breaker tube, to collect a small amount of water from that flowing from the flush valve to the toilet bowl and to convey the collected water to the conduit.

7 Claims, 1 Drawing Sheet

PLUMBING TRAP WATER COLLECTION DEVICE

THE FIELD OF THE INVENTION

The present invention is concerned with the supply of water to prime a trap normally located beneath a toilet bowl. Such traps are utilized to prevent objectionable sewer gases from entering the area of the toilet room where the bowl is located. Water must be constantly provided to the trap to replace evaporated water and this is done by diverting a small amount of water to the trap every time the toilet bowl is flushed. The present invention provides a water scoop which is positioned in the vacuum breaker tube which connects the toilet flush valve to the toilet bowl, with the scoop being so designed that regardless of its orientation, it will always divert a small amount of the water flowing through the vacuum breaker tube to the trap beneath the toilet bowl.

SUMMARY OF THE INVENTION

The present invention relates to a means for supplying water to a trap beneath a toilet bowl to prevent sewer gases from entering the area surrounding the bowl.

A primary purpose of the invention is a water diversion device which is positioned within the vacuum breaker tube which connects the toilet flush valve to the toilet bowl, with the diversion device supplying water to the trap.

Another purpose of the invention is a water diversion device or scoop which is positioned as described and which, regardless of its orientation within the vacuum breaker tube, will always be in a position to collect an amount of water from that flowing through the vacuum breaker tube.

Another purpose is a simply constructed reliably operable water diversion device which is transversely positioned within a vacuum breaker tube to collect a small amount of the water flowing therethrough.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
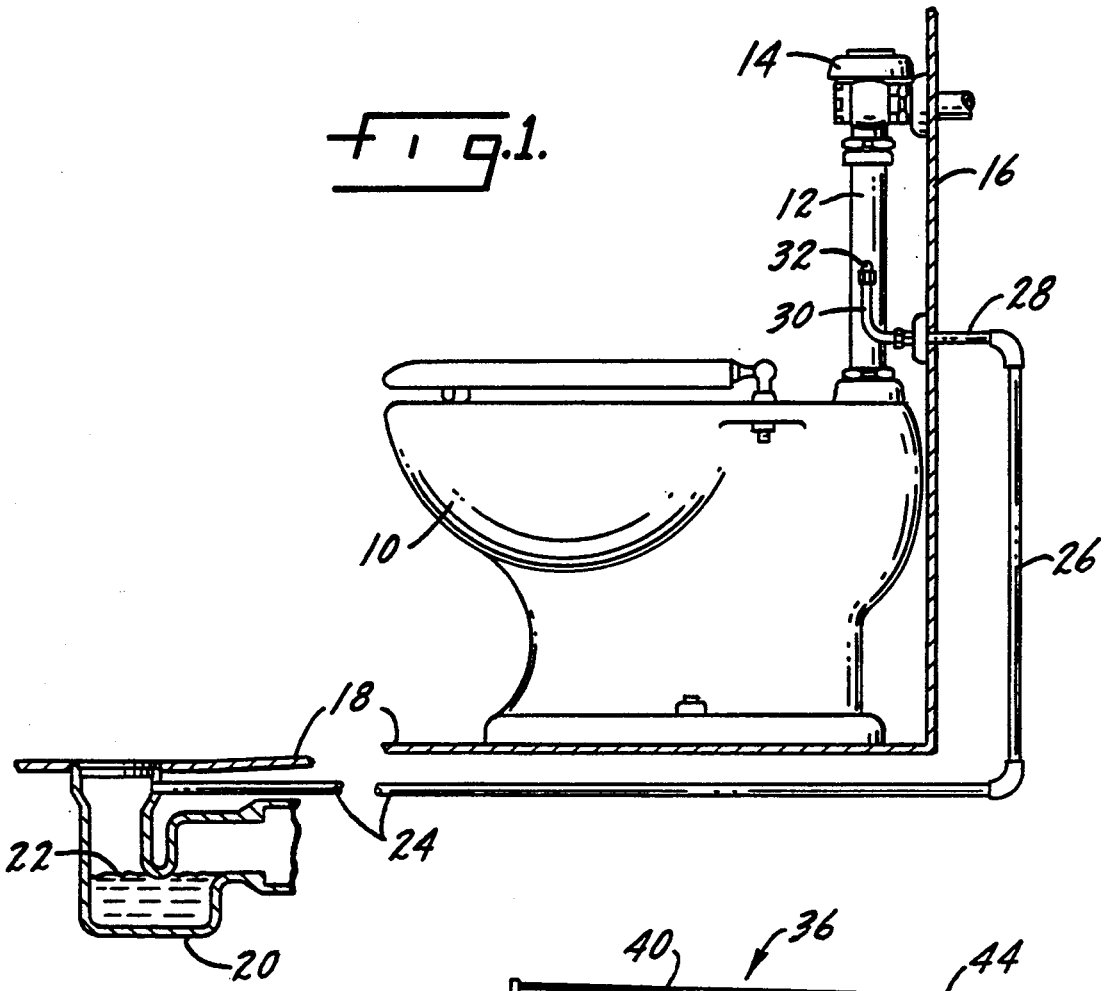
FIG. 1 is a diagrammatic illustration of a toilet bowl, its connected flush valve and vacuum breaker tube and the trap which is positioned beneath the toilet bowl.

In the drawings, a conventional toilet bowl is indicated at 10 and is connected by a vacuum breaker tube 12 to a flush valve 14 which may be of the type manufactured by Sloan Valve Company of Franklin Park, Ill., assignee of the present application, and sold under the trademark ROYAL. Valves of this type may either have a manual operating lever, may be operated electrically by a solenoid on a time basis, or may be operated after use by infrared sensors. The subject matter of the present invention may be used with many types of toilet flushing devices.

The wall behind the toilet bowl 10 is indicated at 16 and the floor upon which the toilet bowl seats is indicated at 18. There is a trap 20 which is conventional in toilet installations and it is necessary to maintain a level of water, indicated at 22, within the trap 20 to prevent objectionable sewer gases from within the waste disposal system from passing into the area of the toilet facility. The trap 20 is connected by a horizontal conduit 24, a vertical conduit 26, a second horizontal conduit 28 which passes through wall 16, and a curved conduit 30, to a fitting 32, which, as illustrated in more detail in FIG. 2, is in communication with the vacuum breaker tube 12.

Figure 2:
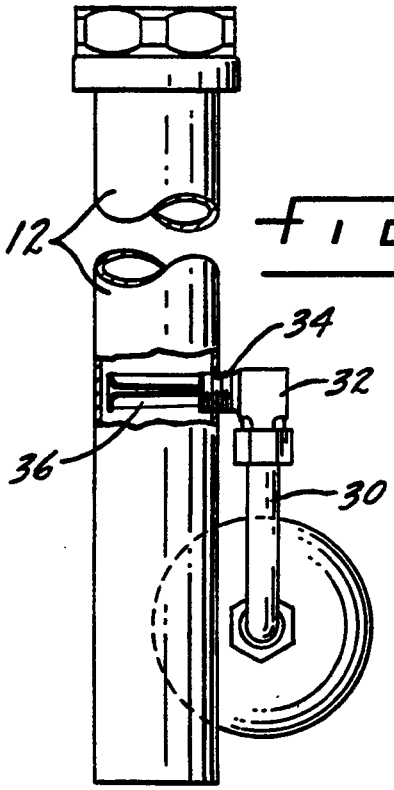
FIG. 2 is an enlarged partial section illustrating the vacuum breaker tube and the water collection device positioned therein.

As particularly shown in FIG. 2, the fitting 32 extends through an opening 34 in the wall of the vacuum breaker tube 12. The purpose of the described conduits and fitting is to collect a small amount of water from that flowing through the vacuum breaker tube and convey it to the trap 20 so as to maintain the water level 22 within the trap. To this end, there is a water diverter, or water collecting device or scoop, indicated generally at 36 and illustrated in detail in FIGS. 3 and 4. The device illustrated in FIGS. 3 and 4 may be termed a water scoop or a diverter, since its function is to divert a portion of the water passing through the vacuum breaker tube or to scoop a portion of that water out of the water flow and convey it to the fitting 32.

Figure 3:
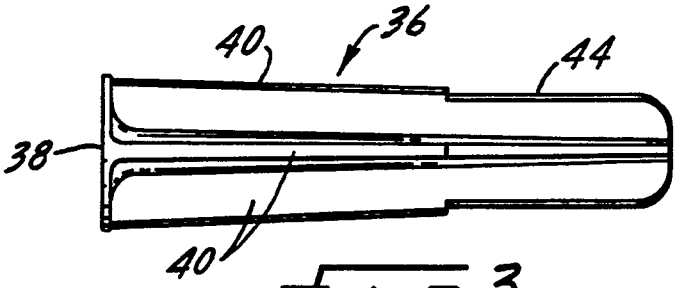
FIG. 3 is an enlarged side view of the water collection device.

The scoop 36 has an inner end 38 which is flat and when positioned within the vacuum breaker tube will be closely adjacent the side of the tube opposite the opening 34. Extending to the right, as illustrated in FIG. 3, from the face 38 are a plurality, in this case five, of axially extending ribs 40. The ribs define a plurality, in this case five, of generally equally peripherally disposed and equally sized troughs 42. As particularly shown in FIG. 3, each of the ribs has an area of slightly decreased radial extent, indicated at 44, with the outer diameter of the scoop 36 in the area of the rib areas 44 being sized to permit the scoop to be inserted within the inner diameter of the fitting 32. Thus, the scoop will be mounted within the fitting, extending generally transversely in the vacuum breaker tube, and across the path of water flow within the tube.

Figure 4:
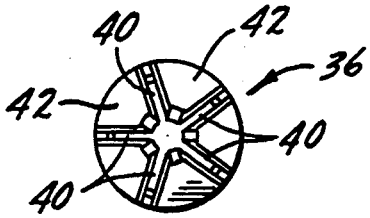
FIG. 4 is an end view, from the right side of FIG. 3, illustrating the water collection device.

As particularly shown in FIG. 4, the size and arrangement of the troughs 42 is such that regardless of the position of the scoop 36 within the vacuum breaker tube, i.e. regardless of how the ribs are oriented, there will always be at least one of the troughs which will be, at least in part, facing in an upward direction. Thus, there will always be a trough to catch a portion of the water passing through the vacuum breaker tube, convey that water to the fitting 32 where it will pass through the described conduits to the trap 20.

The size of the scoop and the amount of water which it collects will vary. A trough which will collect approximately 45 cc of water every time the flush valve is operated has been found to be satisfactory and will provide sufficient water to maintain a conventional water seal in the trap without detracting from the amount of water required to sufficiently flush out the bowl.

The scoop may be made of plastic and will conventionally be installed in the field. The installer need not be concerned about the orientation of the scoop when it is installed, as regardless of its orientation, it will always be in a position to collect or divert some portion of the water passing through the vacuum breaker tube to the trap.

Whereas the preferred form of the invention has been shown and described herein, it should be realized that there may be many modifications, substitutions and alterations thereto.

The embodiments of the invention in which an exclusive property or privilege is claimed are defined as follows:

1. Means for collecting water from a vacuum breaker tube that connects a toilet flush valve to a toilet bowl and conveying the collected water to a trap located beneath the toilet bowl, including a conduit, one end of which is in communication with the vacuum breaker tube and the other end of which is in communication with the trap, a water scoop positioned within the vacuum breaker tube and in fluid connection with the conduit, said scoop having a plurality of generally parallel separated troughs formed and adapted to collect a small amount of water from the water flowing from the flush valve to the toilet bowl and to convey the collected water to the conduit.

2. The water collection means of claim 1 further characterized in that said scoop extends generally transverse to the path of water flow within the vacuum breaker tube.

3. The water collection means of claim 2 further characterized in that said scoop is attached to said conduit.

4. The water collection means of claim 1 further characterized in that said troughs are peripherally disposed about said scoop.

5. The water collection means of claim 4 further characterized in that each of said troughs is separated by an axially extending rib.

6. The water collection means of claim 5 further characterized in that one end of each of said axially extending ribs is positioned within said conduit to mount said scoop to the conduit.

7. The water collection means of claim 4 further characterized in that the number of separate troughs is such that regardless of the orientation of the scoop within the vacuum breaker tube, at least one trough is always positioned to receive water flowing downwardly through the vacuum breaker tube.

* * * * *